United States Patent [19]

Murphy

[11] Patent Number: 4,527,316

[45] Date of Patent: Jul. 9, 1985

[54] JEWELRY CHAIN-STAY

[76] Inventor: Joanne Murphy, 6992 NW. 30 Ave., Ft. Lauderdale, Fla. 33309

[21] Appl. No.: 477,348

[22] Filed: Mar. 21, 1983

[51] Int. Cl.[3] ..... F16G 15/00; A44C 5/02

[52] U.S. Cl. ..... 24/616; 24/116 A; 24/618; 63/2; 63/4; D11/11

[58] Field of Search ..... 24/616, 614, 615, 618, 24/697, 650, 572, 475, 620; 63/1, 2, 4; D11/11, 87

[56] References Cited

U.S. PATENT DOCUMENTS

| | | | |
|---|---|---|---|
| 1,485,027 | 2/1924 | Grunebaum | 63/2 |
| 1,813,963 | 7/1931 | Schick | 24/616 |
| 2,138,596 | 11/1938 | Fassnacht | 63/2 |
| 2,266,074 | 12/1941 | Rauer | 24/616 |
| 2,477,354 | 7/1949 | Teolis | 24/616 |
| 2,513,592 | 7/1950 | Silverman | 24/616 |
| 2,858,593 | 11/1958 | Iribarry | 24/618 |
| 3,170,311 | 2/1965 | Raphael | 24/116 A |
| 3,208,238 | 9/1965 | Spitzer | D11/11 |
| 3,225,406 | 12/1965 | Levy | 24/616 |
| 3,421,341 | 1/1969 | Hodge | 63/4 |

FOREIGN PATENT DOCUMENTS

| | | | |
|---|---|---|---|
| 213881 | 8/1956 | Australia . | |
| 914261 | 1/1963 | United Kingdom | 63/2 |

*Primary Examiner*—Victor N. Sakran

*Attorney, Agent, or Firm*—Eugene F. Malin

[57] ABSTRACT

An improved interlocking chain fastener system to attach multiple ornamental chains having any size or length. The chain fastener system is designed with at least two male portions and at least two female portions on alternate sides of the fastener. The device allows for attachment of multiple conventional ornamental chains to a single fastener and allows the chains to hang in a tangle-free concentric pattern.

4 Claims, 3 Drawing Figures

JEWELRY CHAIN-STAY

SUMMARY OF THE INVENTION

This invention relates to a chain fastener system which provides for a means of attaching conventional multiple ornamental chains to a single fastener. The chain fastener system allows the wearer to attach multiple ornamental chains to a single fastener and have the chains hang in a tangle free, untwisted concentric pattern. The fastener also allows the wearer to attach multiple ornamental chains of the same length to a single fastener and have the chains hang, at varying lengths, in a tangle-free and untwisted concentric pattern.

It is an object of this invention to have a single fastener to attach multiple ornamental chains.

It is another object of this invention to keep the conventional ornamental chains from becoming tangled or twisted.

It is yet another object of this invention to allow conventional ornamental chains of the same length to hang at varying lengths.

It is a further object of this invention to allow an individual to attach multiple chains to the alternative sides of a two part chain fastener system and only have to close one fastener to attach to the wearer.

BACKGROUND OF THE INVENTION

Commonwealth of Austrlia Pat. No. 213,881 relates to a fastening means for a variable number of rows of beads. The device described relates to a fastener having all male or all female portions on the clasps and all male or all female portions on the beads, respectively. The invention in the present case relates to a chain fastener system that has male portions on one side and female portions on the other side, respectively. This new improved chain fastener system allows for conventional ornamental claims to be attached to the fastener device rather than requiring rows of beads with a specific terminal portion, i.e., both terminal ends are male or both terminal ends are female.

DETAILED DESCRIPTION

Figure 1:
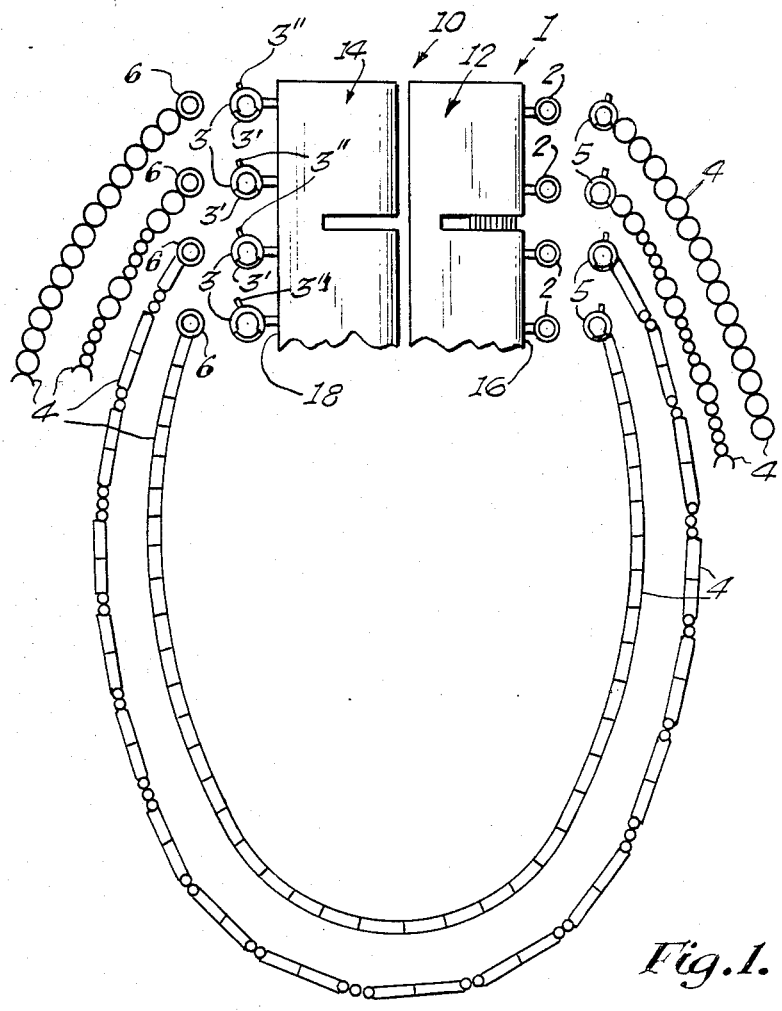
FIG. 1 shows the preferred embodiment of the two-part fastener system with conventional ornamental chains.
Figure 3:
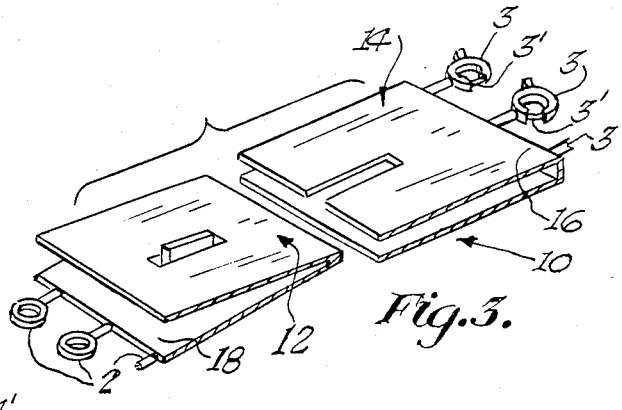
FIG. 3 shows a lateral view of the two-part fastener means.

Referring to FIGS. 1 and 3, the interlocking chain fastener system 1 includes a male portion 12 and a female portion 14. At least two closed ring portions 2 and at least two jump ring portions 3 are affixed to alternate sides of said male portion 12 and said female portion 14. The jump ring includes a movable portion 3″ that may be opened by handle 3″ against a spring not shown to open jump ring to connect a closed ring. The closed ring portions 2 and jump ring portions 3 may be of various shapes and are not limited to circular rings, but could include ovals, squares and the like. Other male and female connectors may be used. The closed ring portions 2 and the jump ring portions 3 are on opposite sides 16 and 18 of the interlocking chain fastener 10. The interlocking chain fastener 10 is used with conventional ornamental chains 4 having a close ring portion 6 at one end and a jump ring portion 5 at the opposite end. The closed ring portion 6 of the conventional ornamental chain 3 is attached to the jump ring portion 3 of the interlocking fastener means 1. The jump ring portion 5 of the conventional ornamental chain 3 is attached to the closed ring portion 2 of the interlocking chain fastener or fastener means 10. A plurality of conventional ornamental chains 4 are attached in this manner. The closed ring portions 2 of the fastener means 10 are spaced apart (vertically as shown) along the lateral side 16 of the male portion 12 of the fastener means 10. The jump ring portion 3 of the fastener means 10 are spaced apart (vertically as shown) along the lateral portion 18 of the female portion 14 of the fastener means 1. The jump ring portions 3 and the closed ring portions 2 may be attached to either the male portion 12 or female portion 14. The arrangement of the jump ring portion 3 are successively spaced along the lateral portion 18 of the fastener means 1.

The closed ring portions 2 of the fastener means 10 are successively spaced along the lateral portion 18 of the fastener means 10. The spacing of the jump ring 3 and the closed ring 2 are grouped in a particular manner to allow a plurality of conventional ornamental chains 4 to hang in concentric tangle-free rows.

The arrangement of the jump rings 3 of the fastener means 1 and the closed rings 2 of the fastener means 1 allows conventional ornamental chains of similar length to hang at varying lengths in a tangle-free manner.

The fastener means 1 is not limited to conventional ornamental chains that are used on necklaces it may also be used for a plurality of bracelets having a closed ring portion at one end and a jump ring portion at the opposite end.

Figure 2:
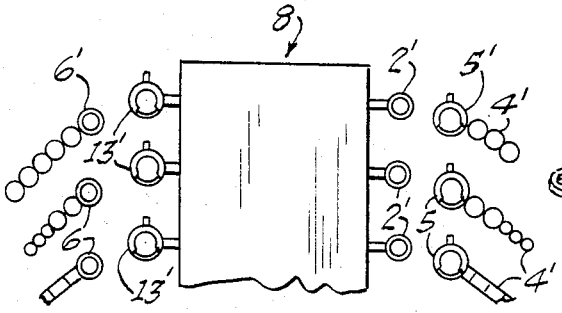
FIG. 2 shows an alternate embodiment utilizing a single-part fastener system.

Referring to FIG. 2, an alternative embodiment is shown as a one-piece chain fastener or fastener means 8, with closed ring portions 2′ and jump ring portions 13′ as described above. The jump ring portions 5′ of the conventional ornamental chains 4′ are attached to the closed ring portions 2′ of the one-piece chain fastener 8. The closed ring portions 6′ of the conventional ornamental chains 4′ are attached to the jump ring portions 6′ of the one-piece chain fastener 8. The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A chain fastener system comprising:

a fastener means having a face portion, a rear portion, and opposite lateral portions including a first lateral portion and a second lateral portion;

said first lateral portion including at least two male connector portions;

said second lateral portion including at least two female connector portions;

said fastener means for connecting the ends of a plurality of conventinal ornamental chains each having a closed ring at one end connectable to one said female connector portion and a jump ring at the other end connectable to one said male connector portion;

said fastener means for allowing the chains to hang in concentric tangle-free rows.

2. A chain fastener system comprising:

a fastener means having a face portion, a rear portion, and opposite lateral portions including a first lateral portion and a second lateral portion;

said first lateral portion including at least two male connector portions;

said second lateral portion including at least two female connector portions;

said fastener means for connecting the ends of a plurality of conventinal ornamental chains each having a closed ring at one end connectable to one said female connector portion and a jump ring at the other end connectable to one said male connector portion;

said fastener means for allowing the chains to hang in concentric tangle-free rows, said fastener means includeing two connectable parts, a first part having a male connecting means, and a second part having a female connecting means, said male connecting means of said first part is removably connected to said female connecting means of said second part.

3. A chain fastener system as set forth in claim 2, wherein:

said male connector means affixed to one side of said first part and said at least two female connector portions connected to the opposite side of said second lateral portion; said female connector means affixed to one side of said second part and said at least two male connector portions connected to the opposite side of said first lateral portion, said male connector means and said female connector means connect and disconnect said first part from said second part.

4. A chain fastener system comprising:

a fastener means having a face portion, a rear portion, and opposite lateral portions including a first lateral portion and a second lateral portion;

said first lateral portion including at least two male connector portions;

said second lateral portion including at least two female connector portions;

said fastener means for connecting the ends of a plurality of conventional ornamental chains each having a closed ring at one end connectable to one said female connector portion and a jump ring at the other end connectable to one said male connector portion;

said fastener means for allowing the chains to hang in concentric tangle-free rows, and a plurality of ornamental chains each having a closed ring at one end and a jump ring at the other end, said male connector portions and said female connector portions arranged in successive rows along the lateral portions of said fastening means, each of said chains connected to said fastener means by connecting said closed ring at one end of each said chain and said jump ring at the other end of each said chain to said male connecting portion and to said female connecting portion respectively.

* * * * *